US006238258B1

(12) United States Patent
Ozawa

(10) Patent No.: US 6,238,258 B1
(45) Date of Patent: May 29, 2001

(54) DIRECT AIR FUEL INJECTED WATERCRAFT ENGINE

(75) Inventor: Shigeyuki Ozawa, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/200,011

(22) Filed: Nov. 25, 1998

(30) Foreign Application Priority Data

Nov. 26, 1997 (JP) ..... 9-342259

(51) Int. Cl.[7] ..... B63H 21/38

(52) U.S. Cl. ..... 440/88; 123/533

(58) Field of Search ..... 440/88; 123/65, 123/533, 559.1, 560; 114/55.1

(56) References Cited

U.S. PATENT DOCUMENTS

| | | | | |
|---|---|---|---|---|
| 4,068,612 | * | 1/1978 | Meiners | 440/89 |
| 5,233,952 | * | 8/1993 | Isaka | 123/41.31 |
| 5,239,970 | * | 8/1993 | Kurihara | 123/533 |
| 5,261,356 | * | 11/1993 | Takahashi et al. | 440/88 |
| 5,375,578 | * | 12/1994 | Kato et al. | 123/516 |
| 5,390,621 | * | 2/1995 | Hattori et al. | 114/55.51 |

* cited by examiner

*Primary Examiner*—Sherman Basinger
(74) *Attorney, Agent, or Firm*—Ernest A. Beutler

(57) ABSTRACT

A number of embodiments of personal watercraft having engines that employ fuel air injection systems. The fuel air injection system is protected from water ingestion by placing its inlet in an area that will be above the water level regardless of whether the watercraft is operating upright or is inverted and during the transition between those positions. In addition, an arrangement is provided for cooling the air compressor so as to improve efficiency.

16 Claims, 10 Drawing Sheets

WL
WL
WL

DIRECT AIR FUEL INJECTED WATERCRAFT ENGINE

BACKGROUND OF THE INVENTION

This invention relates to a personal watercraft and more particularly to an improved direct injected engine therefore that includes an air fuel injector.

In order to improve the efficiency and exhaust emission control for two cycle engines to permit their continued use in applications where compact, high output engines are required, it has been proposed to employ direct cylinder injection systems. Such systems inject the fuel directly into the combustion chamber of the engine. This permits more efficient control of the amount of fuel introduced as well as the timing thereof to improve engine efficiency.

With two cycle engines, on the other hand, at least a portion of the injection cycle takes place at the same time scavenging is occurring and hence, the fuel must be injected fairly rapidly over a relatively short time period to avoid escape along with the exhaust gasses. This results in high injection pressures that can present problems such as fuel condensation on the walls of the combustion chamber.

It has been well known that in order to improve fuel atomization, air may be injected along with the fuel so as to prevent these problems. This concept was utilized in the earliest internal combustion engines. However, the application of air fuel injectors for such small, compact arrangements such as personal watercraft presents significant problems.

A personal watercraft is a well known type of watercraft which may assume many forms. However, a common characteristic of all personal watercraft is that they are designed to be operated by a single rider who may carry no more than two or three additional passengers with him. Also, these watercraft are quite compact and sporting in nature. Frequently, the operator and his passengers are seated in straddled, tandem fashion on a single seat that overlies, in part, the engine compartment.

Thus, the engine is positioned in a quite confined location. This is one reason why two cycle engines are desirable for such application. However, where added components such as the components necessitated by a fuel, air injector are incorporated, then the positioning of the components, their serviceability and other factors, which will be mentioned, become quite significant.

It is important that the air that is used with the injection system is compressed to a high enough pressure. Therefore, it is common to use positive displacement pumps for this purpose. However, regardless of the type of air compressor employed, this gives rise to fairly high temperatures. Thus it is important that the compressed air is not heated so highly that it looses its effectiveness.

It is, therefore, a principal object of this invention to provide an improved fuel air injector system for a personal watercraft wherein the air for the compressor and the compressor systems are such that the compressor will be well cooled.

Also, because of the sporting nature of these watercraft, there is a danger that water may enter the air injection system. This can happen due to the fact these watercraft frequently become inverted and subsequently righted. If the air system is such that it becomes immersed in water during this inversion and righting process, then damage can result.

It is, therefore, a still further object of this invention to provide an improved air compressor arrangement for a personal watercraft wherein the compressor and its components are protected from the water.

SUMMARY OF THE INVENTION

This invention is adapted to be embodied in a personal watercraft having a hull with a rider's area designed to accommodate a single operator rider and no more than three passengers. The hull also forms an engine compartment in which an internal combustion engine is positioned. The engine is provided with a fuel air injector that injects fuel and a source of high pressure air into the combustion chamber for combustion therein. The compressed air is supplied to the fuel air injector by an air compressor that draws air from within the engine compartment and which delivers it to the fuel air injector.

In accordance with a first feature of the invention, the inlet for the air compressor is disposed so that it will be above the water level even when the watercraft is inverted and again righted.

In accordance with another feature of the invention, a cooling arrangement is provided for cooling the air compressor.

DETAILED DESCRIPTION OF THE PREFERRED EMBODIMENTS OF THE INVENTION

Figure 1:
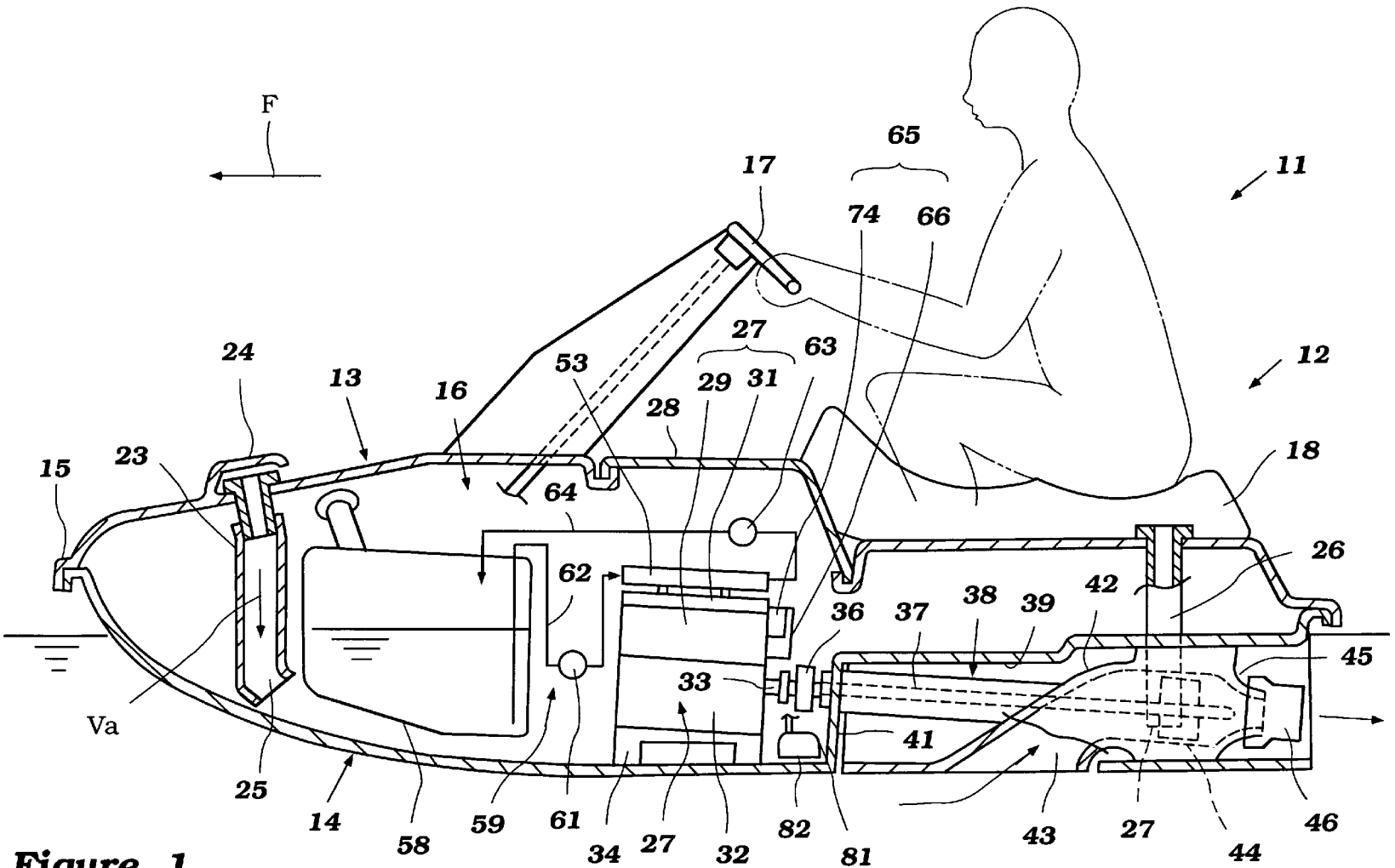
FIG. 1 is a cross-sectional view taken along a longitudinal section of a personal watercraft constructed in accordance with a first embodiment of the invention.
Figure 2:
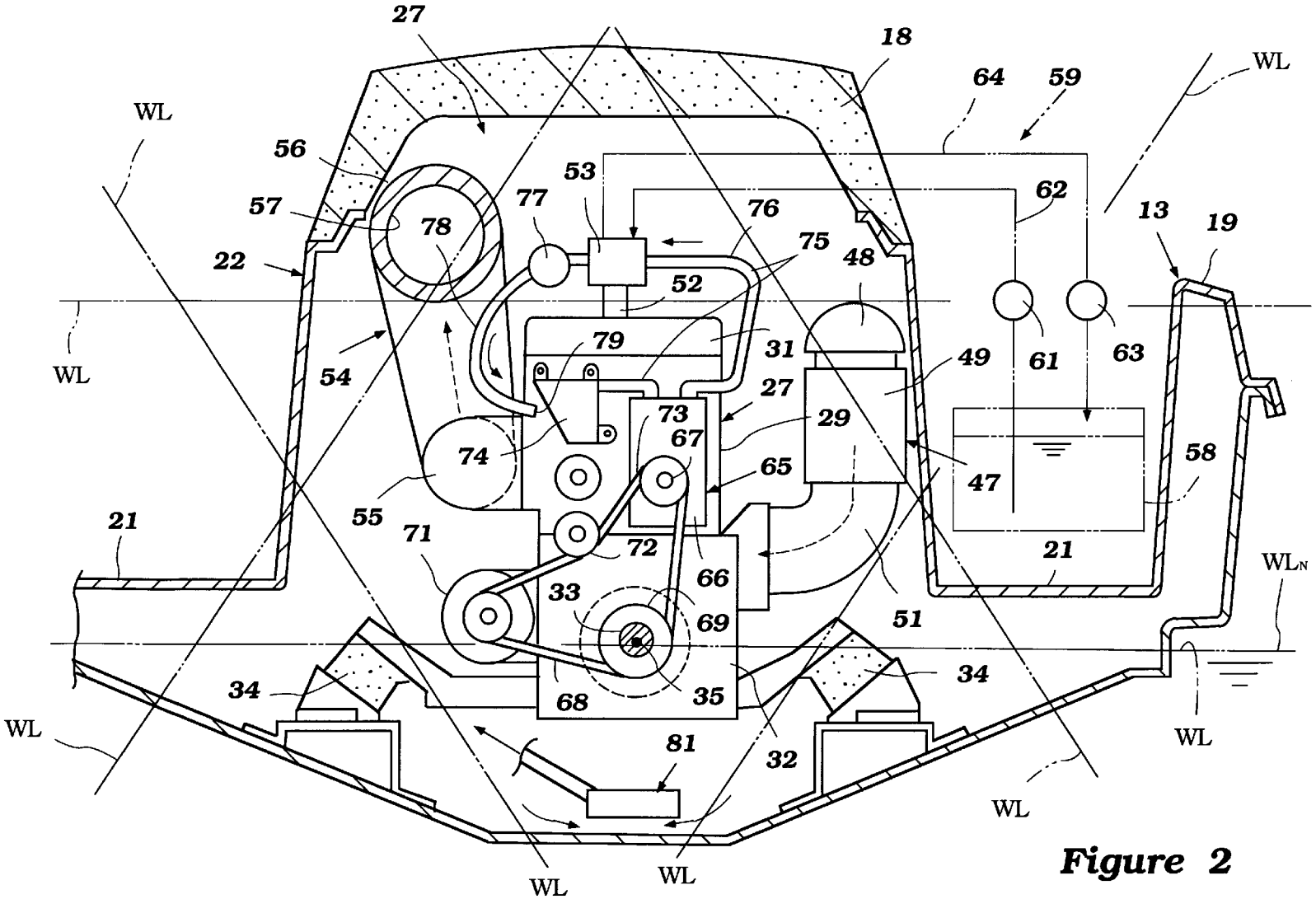
FIG. 2 is a cross-sectional taken transversely to the longitudinal axis of the watercraft and shows various water levels in relation to the engine compartment and components therein when the watercraft is inverted and subsequently righted.
Figure 3:
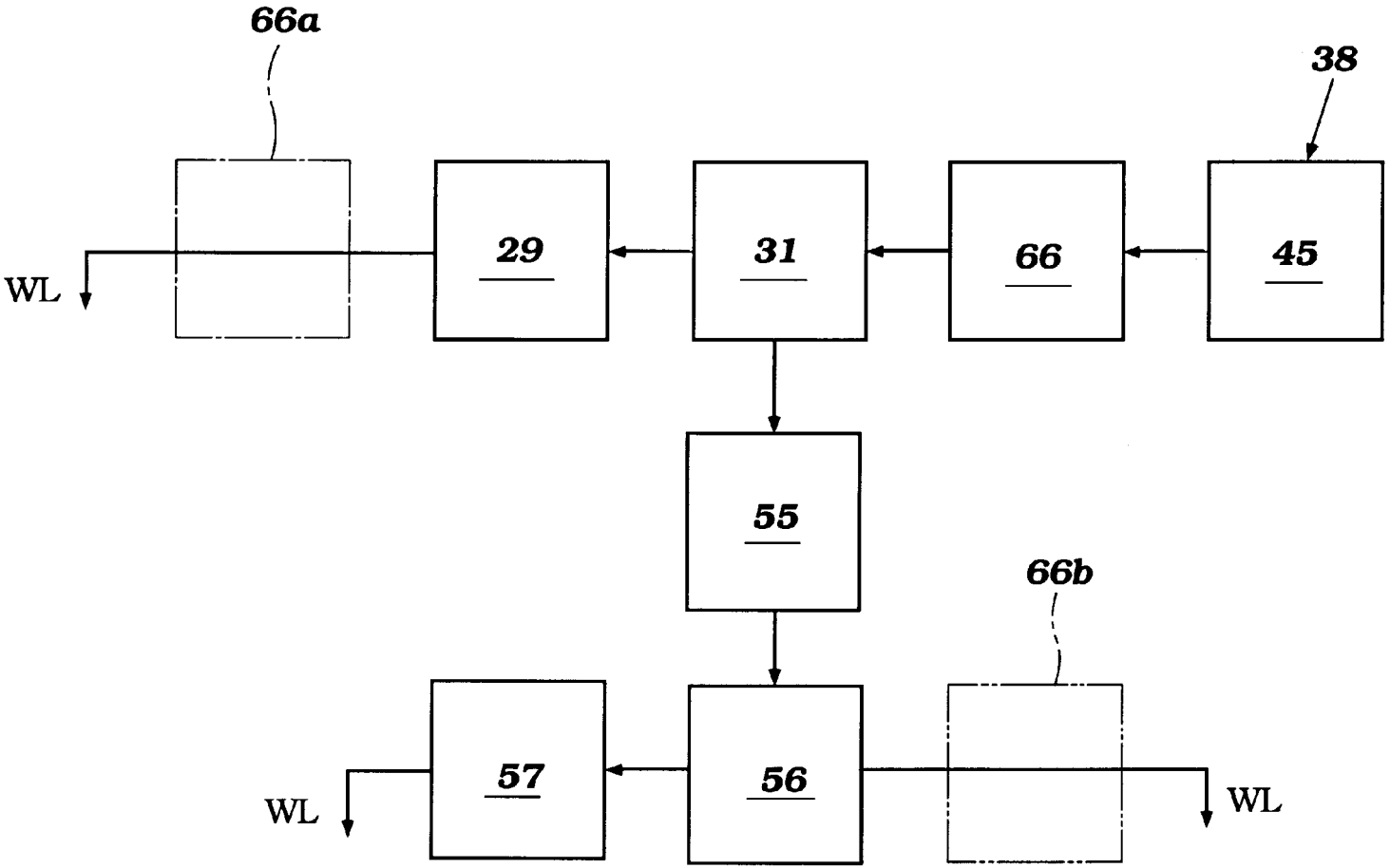
FIG. 3 is a block diagram showing the components and relationship of the cooling system.

Referring first to the embodiment of FIGS. 1–3, a personal watercraft constructed in accordance with this embodiment is identified generally by the reference numeral 11. It is to be understood that the overall configuration of the watercraft 11 is only typical of one of many types of personal watercraft with which the invention may be practiced. The invention is capable of use with all personal watercraft as set forth in the description thereof in the preamble of this application.

The watercraft 11 is comprised of a hull assembly, indicated generally by the reference numeral 12, and which is comprised of a hull deck portion 13 and an under hull portion 14. These hull portions 13 and 14 are formed from a suitable material such as a fiberglass reinforced resin or the like and are fixed together along their outer periphery by a gunnel, indicated at 15. This defines an engine compartment area 16 between the forward portion of the hull and deck portions 14 and 13.

A control mast 17 extends upwardly from the forward portion of the deck 16 and in a position forwardly of a seat 18 upon which a rider operator may be seated in straddle fashion. As may be best seen in FIG. 2, the sides of the portions of the deck 13 are elevated as at 19 on outer sides of depressed foot areas 21 in which a rider, shown in phantom in FIG. 1, may place his feet. The hull has a raised portion 22 that is disposed between the foot areas 21 and upon which the seat 18 is positioned.

The engine compartment 16 is ventilated and this ventilation system includes an air admission pipe 23 that is disposed at a forward portion of the deck 13 beneath a shield 24 through which ventilating air may be drawn as indicated by the arrow Va in FIG. 1. The vent inlet pipe 23 has a downwardly disposed discharge end 25 through which the ventilating air can enter the forward portion of the engine compartment 16 towards the bilge part thereof.

A vent discharge pipe 26 is provided at the rear end of this engine compartment and has an inlet end 27 that is disposed generally at a low area in the rear portion of the compartment 16. The upper or discharge end of the vent pipe 26 is disposed at a convenient location under the seat 18 and which communicates freely with the atmosphere.

An internal combustion engine, indicated generally by the reference numeral 27 is provided in the engine compartment 16 to an area immediately adjacent the forward portion of the rider's area defined by the seat 18 and beneath a removable hatch cover 28 for engine service access. The engine 27 includes a cylinder block 29 having vertically extending cylinder bores (two in this embodiment).

The upper end of the cylinder bores is closed by a cylinder head assembly 31 that is detachably connected to the cylinder block 29 in a known manner. Affixed to the underside of the cylinder block 29 and closing the lower end of the cylinder bores is a crankcase member 32 in which a crankshaft 33 of the engine is rotatably journaled. It should be noted that the internal components of the engine 27 are not illustrated in this embodiment but later embodiments show typical type of engine constructions that may be utilized in conjunction with the invention. Basically, the engine 27 in this embodiment is of the two cylinder inline type and operates on a crankcase compression principal.

Engine mounds mount the engine 27 in the engine compartment 16 at the aforenoted location. The auxiliaries for the engine 27 will be described later.

The engine crankshaft 33 has a rotational axis 35 that extends longitudinally of the longitudinal center line of the hull 12. The aforenoted cylinder bores in this embodiment extend vertically upwardly from this axis 33.

A coupling 36 interconnects the crankshaft 33 with an impeller shaft 37 of a jet propulsion unit, indicated generally by the reference numeral 38. This jet propulsion unit 38 is mounted in substantial part in a tunnel 39 that is formed in the hull undersurface 14 and which is separated in part by the engine compartment 16 by a bulkhead 41.

The jet propulsion unit 38 includes an outer housing 42 that defines a downwardly facing water inlet opening 43 that opens through the hull undersurface. An impeller 44 is affixed to the impeller shaft 37 and draws water through the inlet opening 43. This water is then discharged rearwardly through a discharge nozzle 45. A steering nozzle 46 is pivotally journaled on the discharge end of the discharge nozzle 45 about a vertically extending steering axis. The angle of discharge of the water is controlled by pivoting the steering nozzle 46 under the operation of the control mast 17 so as to change the direction of travel of the watercraft, as is well known in this art.

Returning now to the description of the engine 27 and its auxiliaries, the engine has an air induction system, indicated generally by the reference numeral 47 and which is shown best in FIG. 2. This air induction system 47 includes an air inlet device 48 that is disposed on one side of the engine and which draws air that has been delivered to the engine compartment 16 in the aforenoted manner. This inlet device 48 communicates with a throttle body 49 in which one ore more throttle valves are provide so as to control the air flow to the engine 27 and, accordingly, its speed.

The throttle bodies 4 communicate with intake manifolds 51 which are affixed to the side of the crankcase member 32 and deliver an intake charge to the individual crankcase chambers associated with each of the cylinder bores of the engine. As is well known in two cycle practice, reed type check valves are provided in these inlet ports and the crankcase chambers are sealed from each other in a suitable manner.

The air charge is eventually transferred to combustion chambers formed by the pistons of the engine, the cylinder bores and recesses formed in the cylinder head assembly 31 all of which appear in figures of subsequent embodiments.

Air fuel injectors, indicated at 52, are mounted in the cylinder head assembly 31 and deliver a fuel air mixture to the combustion chambers for burning therein. This fuel air charge is mixed in any known manner in accordance with the construction of the injectors 52. Air and fuel under pressure are delivered to these injectors by a manifold 53 in a manner which will be described later.

Spark plugs, which are not shown in this embodiment, fire the charge delivered at an appropriate time for effecting driving of the engine.

The burnt charge is discharged from exhaust ports formed in the cylinder block 29 on the opposite side from the induction system 47 to an exhaust system, indicated generally by the reference numeral 54. This exhaust system 54 includes an exhaust manifold 55 that is fixed to the cylinder block 29 at one side thereof and which communicates with its exhaust ports, in a known manner.

The exhaust manifold 55 communicates with a combined expansion chamber and exhaust discharge arrangement 56 which extends generally vertically upwardly and which has a flow path 57 that extends along the length of the engine 27 and which communicates with any suitable type of exhaust gas discharge for discharging the exhaust gases to the atmosphere.

Returning now to the manner in which air and fuel are delivered to the manifold 53 under pressure, a fuel tank 58 is disposed in the engine compartment 16 at a position forwardly of the engine 27. This fuel tank 58 is shown out of its actual location in FIG. 2 so as to permit understanding of the operation of the fuel supply system. Basically, this fuel supply system is indicated generally by the reference numeral 59 and includes a pump system including a high pressure pump 61 which is driven in a suitable manner and which draws fuel from the tank 58 and delivers it to a fuel rail portion of the manifold 53. This is done through a conduit 62. A pressure regulator 63, which is also shown out of position in FIGS. 1 and 2, is mounted at the outlet side of the manifold 53 and regulates the pressure of fuel supplied to the fuel air injectors by dumping fuel back to the fuel tank 58 through a return line 64.

Air at regulated pressure is delivered to an air manifold portion of the manifold 53 by an air supply system, indicated generally by the reference numeral 65. This air supply system 65 includes a positive displacement air compressor 66. This air compressor 66 has input shaft 67 that is driven from the crankshaft 33 by means of a drive belt 68. The drive belt 68 is driven by a pulley 69 mounted, in this embodiment, on the rear of the crankshaft 33 forwardly of the coupling 36.

This drive belt 68 also drives a electric generator or alternator 71 for providing electrical power for the watercraft 11 including, if desired, the ignition system for the spark plugs of the engine. An idler pulley 72 is provided by which the tension of the belt 68 may be adjusted. The belt 68 thus drives a driven pulley 73 that is affixed to the pump input shaft 67.

Air for compression by the air compressor 66 is supplied through an air inlet device 74 that is mounted, in this embodiment, on the rear end of the engine and specifically the cylinder block 29. This air inlet device 74 is positioned in a location that is disposed so that it will always above the water line indicated by the various lines WL in FIG. 2 regardless of whether the watercraft is operating at a normal level conditioned in the normal water level WLn or if it is inverted or in any intermediate positions therebetween. Thus, any water which may find its way into the bilge of the hull 12 will not be able to enter the air compression system for the air fuel injector.

The air inlet device 74 supplies air to the air compressor 66 through a supply line 75. The compressed air is delivered to the air manifold portion of the manifold 53 by a compressed air line 76. A pressure regulator 77 is disposed in communication with the air manifold portion of the manifold 53 and regulates the air pressure by discharging the excess air through a conduit 78.

This conduit 78 has a discharge end 79 which faces the opening of the air inlet device 74 so as to supply air to it as well as to provide some cooling air flow across it. It is noted that not only the air inlet 74 is disposed above the water level at all conditions but so also is the air compressor 66. In this way, it will be ensured that the system will be maintained free of water.

A bilge pump, indicated generally by the reference numeral 81 is disposed in a lower portion of bilge and has a downwardly facing inlet opening 82 through which any water that may accumulate in the bilge will be discharged. This bilge pump 81 has its inlet below both the air compressor 66 and it said inlet device 74.

It should also be noted that the air compressor 66 is disposed generally in a location where the air flow from the ventilating inlet opening 25 to the ventilating discharge opening 27 will pass across it so as to further assist in its cooling.

In addition to the air cooling, the engine 27 and also the air compressor 66 is cooled by a water cooling system. This cooling system is shown schematically in FIG. 3 and will be described by reference thereto.

First, the jet propulsion unit 38 and specifically its water inlet opening 43 or more accurately a portion of the water compressed at the discharge nozzle portion 45 is delivered through suitable conduitry to a cooling jacket formed around the air compressor 66. From there, coolant is delivered to a cooling jacket of the engine cylinder head assembly 31.

A portion of this water is then diverted to the exhaust system for its coolant. The water is first delivered to the exhaust manifold 55 and then to the expansion chamber device 56. This water is then dumped into the conduit 57 and returned back to the body of water in which the watercraft is operating along with the exhaust gasses through a suitable return. This provides further exhaust cooling and silencing. In addition, an independent return may also be provided for discharging water directly from the cooling jacket 56 directly back to the body of water in which the watercraft is operating without being introduced with the exhaust gases, as shown in FIG. 3.

The cylinder head 31 also delivers cooling water to the cylinder block 29 and this water is then dumped back into the body of water in which the watercraft is operating through a suitable flow path.

It is to be understood that the specific flow path or flow relationship can be changed. For example, the water flow to the air compressor 66 may take place after the water has passed through the cylinder block 29 as shown at the alternate location 66*a* in FIG. 3. Alternatively, water from the exterior of the expansion chamber 56 may be passed through the air compressor 66 as shown in the alternate location 66*b* in FIG. 3 before it is dumped back into the body of water in which the watercraft is operated.

Figure 4:
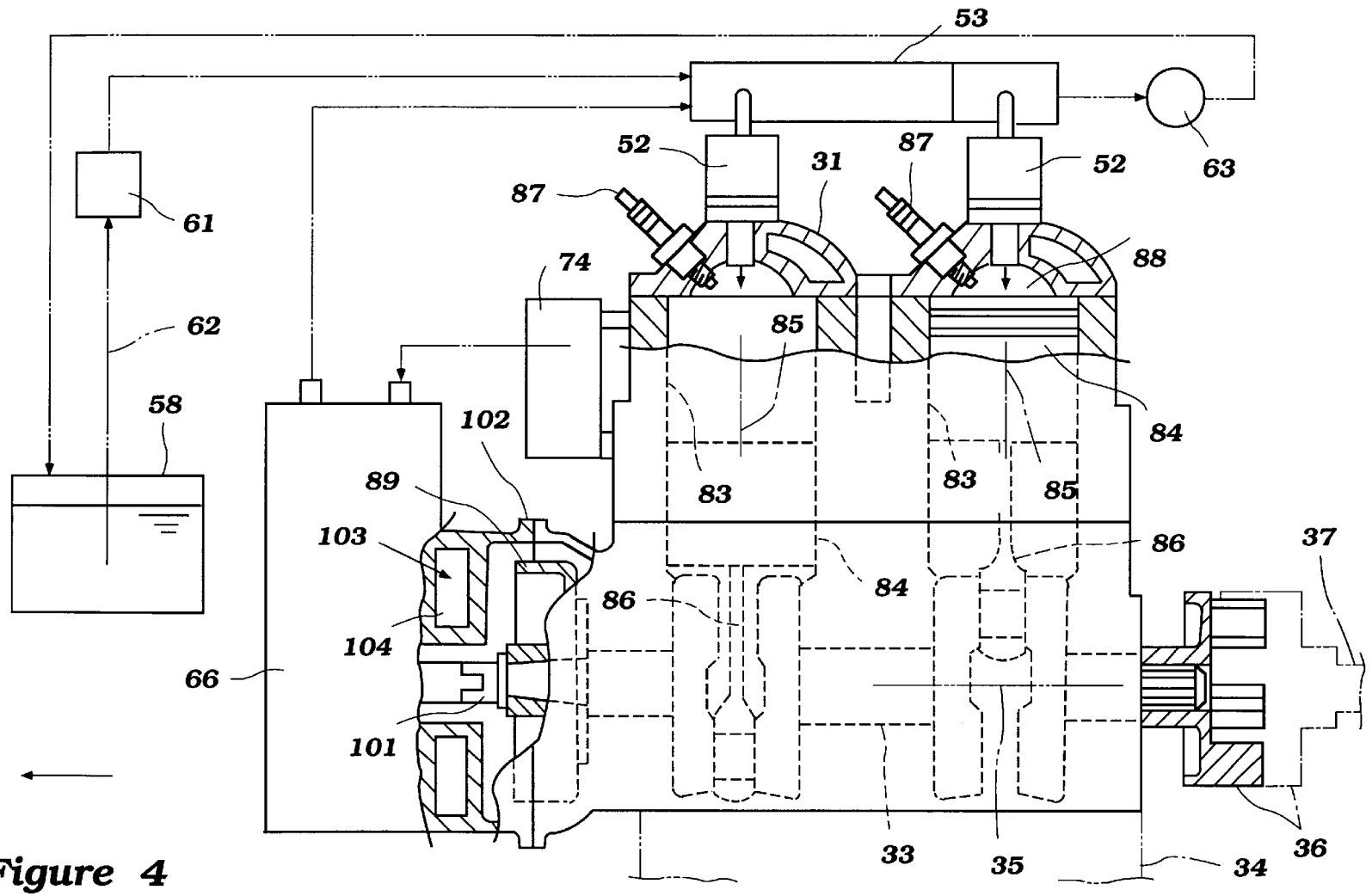
FIG. 4 is a side elevational view looking in the same direction as FIG. 1, but showing only the engine and with portions broken away of a second embodiment of the invention.

FIG. 4 shows not only another embodiment of the invention but also shows some of the components which are not illustrated in FIGS. 1–3. Where components in this embodiment are the same as those previously described, they have been identified by the same reference numerals and will not be described again, except insofar as is necessary to understand the construction and operation of this embodiment.

First, this figures shows the actual cylinder bores, indicated by the reference numerals 83 and the pistons 84 which reciprocate in them. The cylinder bore axes are indicated at 85 in this figure.

The pistons are connected by means of piston pins (not shown) to the upper or small ends of connecting rods 86. The big ends of the connecting rods 86 are journaled on the crankshaft 33 which is shown also in more detail in this figure.

Also, shown in this figure are the spark plugs 87 which have their gaps extending into combustion chamber recesses 88 formed in the lower surface of the cylinder head assembly 31.

This view also shows a flywheel 89 mounted on the forward end of the crankshaft 33.

In this embodiment, the air compressor 66 is driven directly off of the nose of the crankshaft 33 by means of a drive coupling 101. In this embodiment, the outer housing 102 of the air compressor 66 is provided with an integral water jacket 103 having a portion 104 that encircles the general pump assembly for cooling. The flow path through the jacket 104 may be of the type as described in FIG. 3. In all other regards, this embodiment is the same as those previously described and, therefore, further description of this embodiment is not believed to be necessary to permit those skilled in the art to understand the invention.

Figure 5:
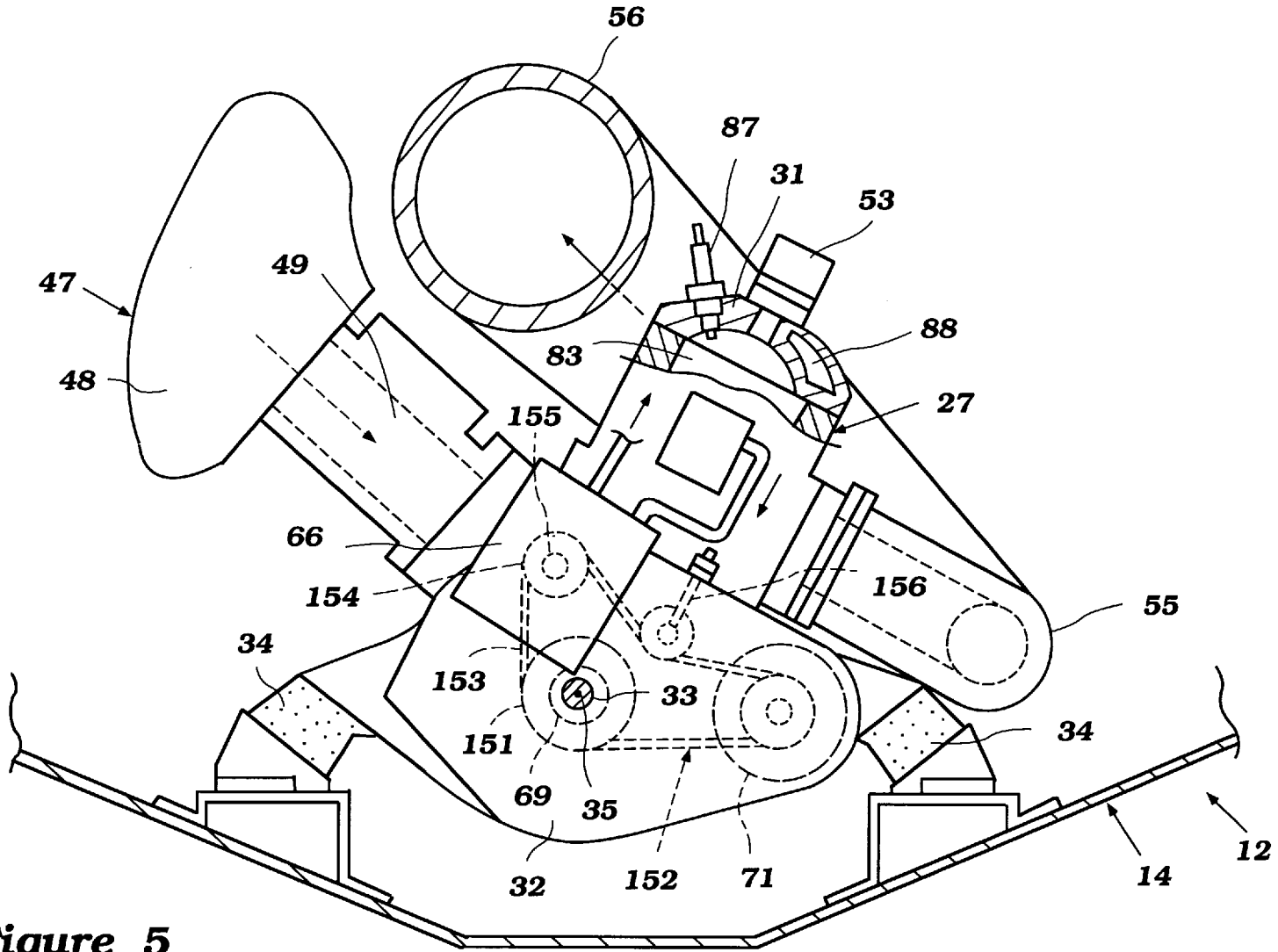
FIG. 5 is a cross-sectional view, in part similar to FIG. 2, and shows a third embodiment of the invention.
Figure 6:
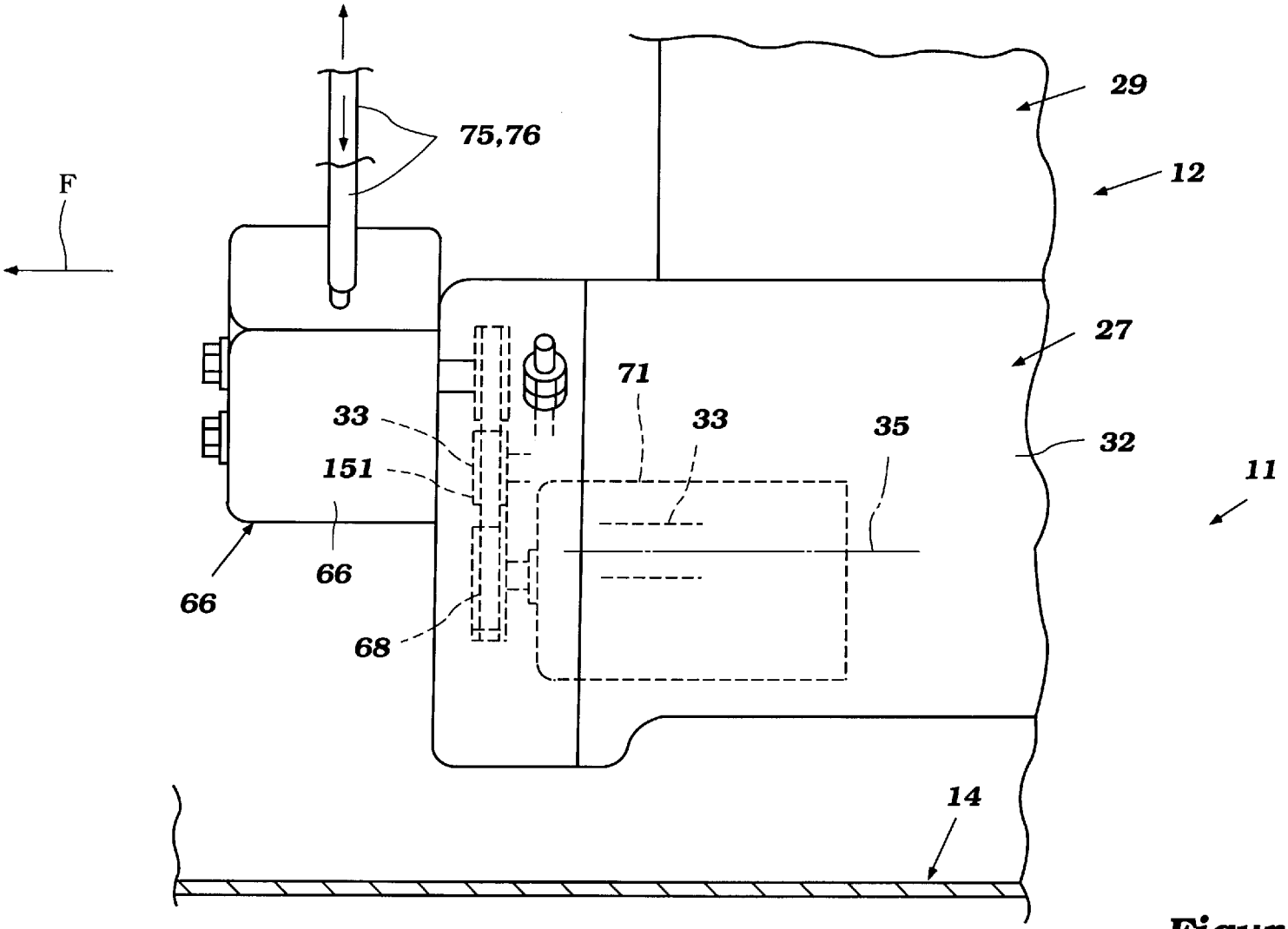
FIG. 6 is an enlarged side elevational view of this third embodiment and showing the drive arrangement for the air compressor.

FIGS. 5 and 6 show a third embodiment of the invention. This embodiment differs from the embodiments thus far described in two regards. The first is that the engine 27 is mounted in the hull 12 so that the cylinder bore axes 85 are inclined at an acute angle to a vertical plane. As a result of this, the configuration of the induction and exhaust systems is somewhat different in that the expansion chamber device 56 is disposed on the induction system side of the engine adjacent the air inlet device 48.

Another difference, however, is the manner in which the air compressor 66 is driven. In this embodiment, the front end of the crankshaft 33 has affixed to it a drive pulley 151. This drive pulley 151 drives a compressor drive 152 that is comprised of a drive belt 153. The drive belt 153 is entrained around a pulley 154 fixed to the air compressor inlet shaft 155.

In this embodiment, the alternator generator 71 is disposed along the front side of the engine and is also driven by the drive belt 152. A tensioner mechanism 156 cooperates with the drive belt 153 to maintain the desired tension in it.

The varying positions thus far described all have in common that the air inlet device 74 for the air compressor 66 is located above the water level in all positions of the watercraft.

Figure 7:
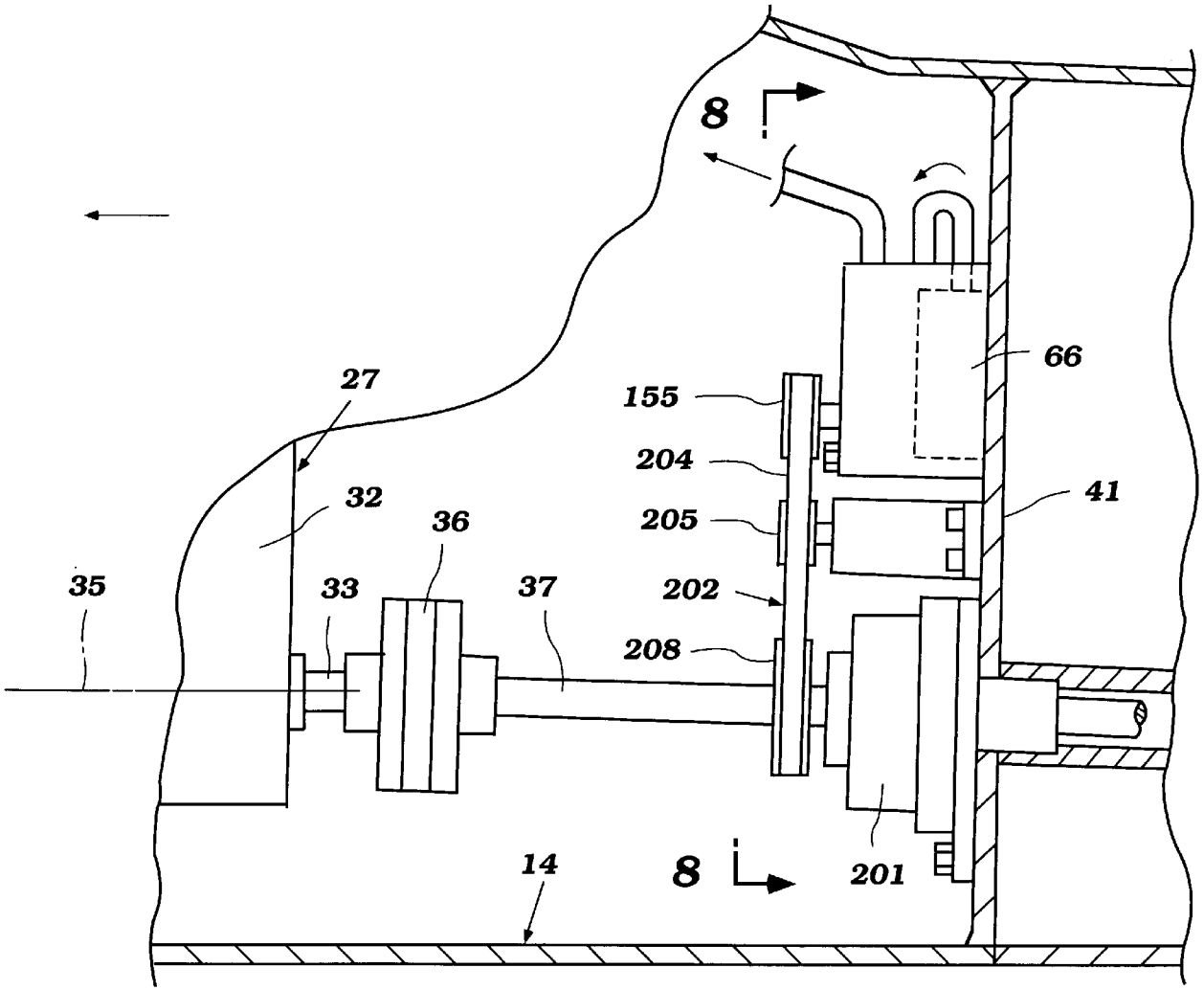
FIG. 7 is a cross-sectional view looking generally in the same direction as FIGS. 1, 4 and 6 and shows a fourth embodiment of the invention.
Figure 8:
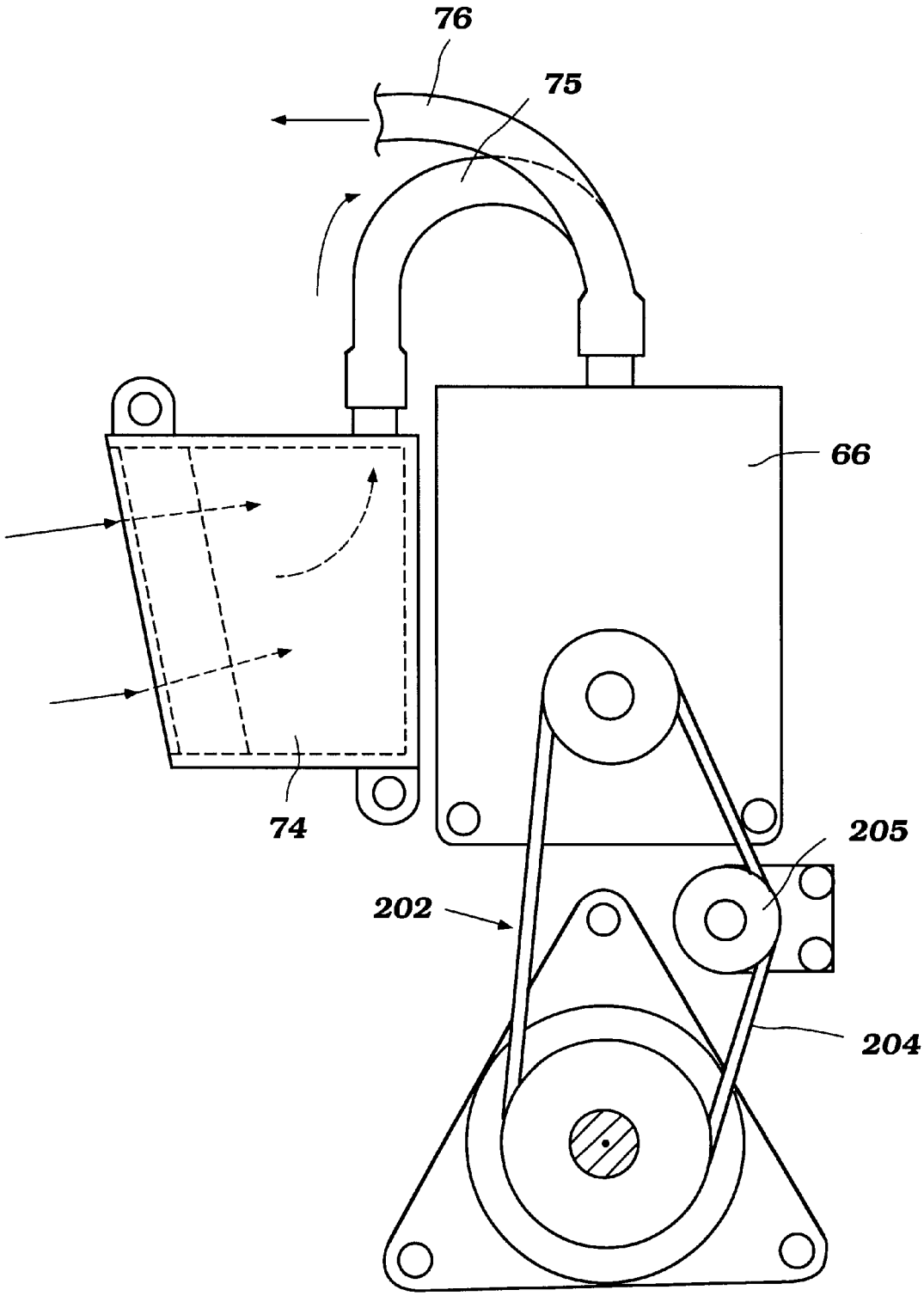
FIG. 8 is a view looking in the direction of the line 8—8 of FIG. 7.

FIGS. 7 and 8 show another mounting and drive arrangement for the air compressor. Since the components of the air compressor 66 including the air inlet and outlet devices are the same, they have been identified by the same reference numerals and will be described again only where necessary to understand the construction and operation of this embodiment.

In this embodiment, the forward end of the impeller shaft 73 is journaled on the bulkhead wall 41 by a bearing arrangement, indicated generally by the reference numeral 201. The air compressor drive, indicated by the reference numeral 202 is disposed immediately forwardly of this mounting assembly 201. This includes a driving pulley 203 which drives a drive belt 204. The drive belt 204 is entrained around the drive pulley 154 of the air compressor 66. In addition, a tensioner pulley 205 is mounted on the bulkhead 41 so as to appropriately tension the drive belt 204.

Like the preceding embodiments, the air compressor 66 is provided with a water jacket through cooling water is circulated to any one of the paths as set forth in FIG. 3.

Figure 9:
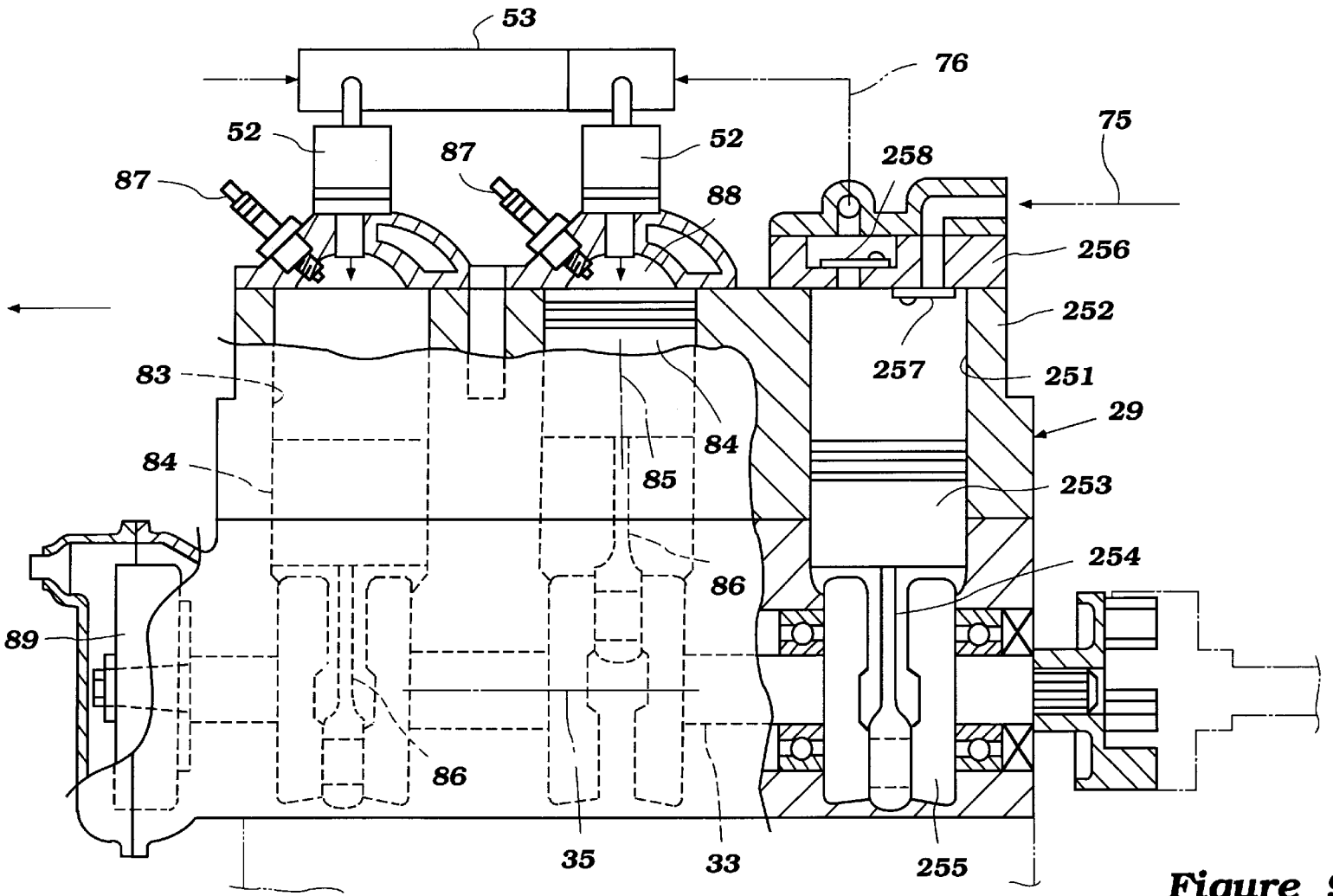
FIG. 9 is a side elevational view, with portions broken away, in part similar to FIGS. 1 and 4 and shows a fifth embodiment of the invention.
Figure 10:
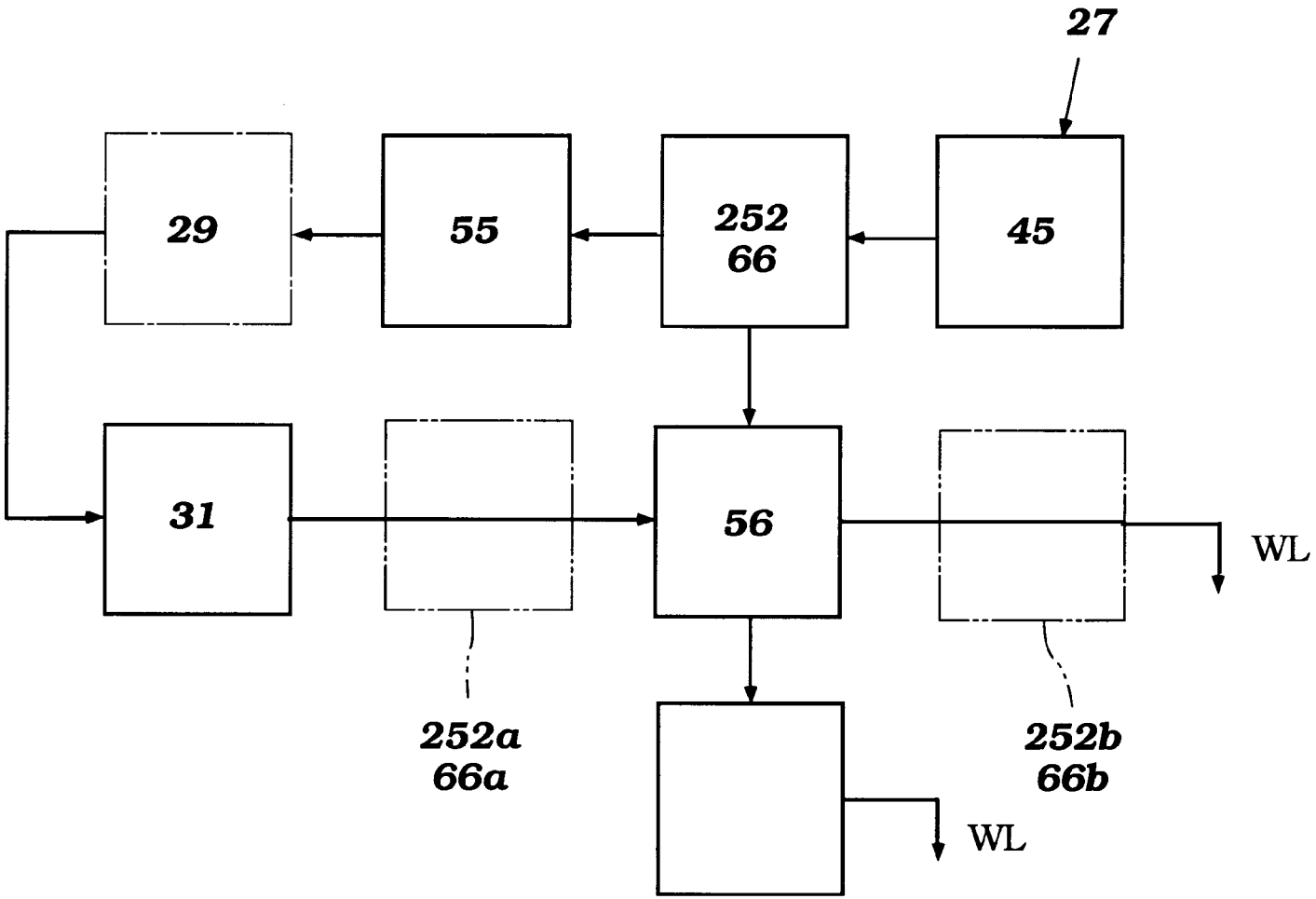
FIG. 10 is a block diagram, in part similar to FIG. 3, and shows the cooling arrangement for the fifth embodiment.

FIGS. 9 and 10 show the fifth and final embodiment of this invention. In this embodiment, the air compressor, still indicated by the reference numeral 66 is formed integrally with the engine. Thus, the cylinder block 29 is lengthened so as to provide a further, compressor cylinder bore 251 in an extension 252 thereof. A compressor piston 253 is supported for reciprocation in this cylinder bore 251. A connecting rod 254 is connected to the piston 253 by a piston pin (not shown). This connecting rod is journaled on an additional throw 255 of the crankshaft 33.

A compressor cylinder head 256 is affixed to the cylinder block extension 252 and closes the compressor cylinder bore 251. Air from the compressor air inlet device 74 is delivered through the conduit 75 to an inlet check valve 257 which permits the air to be drawn into the compressor cylinder bore 251. The compressed air charge is discharged through a delivery check valve 258 to the line 76.

In view of this arrangement, a slightly different cooling path may be provided and this is shown in FIG. 10. Again, the jet propulsion unit 27 and specifically the discharge nozzle portion 45 delivers cooling water first to the cylinder bore extension 252 for cooling the air compressor 66.

Water is then delivered to the exhaust manifold 55 and from that to the cooling jacket of the engine cylinder block 29.

From the engine cylinder block cooling jacket 29, cooling water is delivered to the cooling jacket of the cylinder head 31. Then, the cooling water is delivered to the cooling jacket of the expansion chamber 56. A portion of this cooling water is then dumped into the exhaust gas passage 57 of the expansion chamber device 56 and then returned to the body of water. Some of the coolant from the expansion chamber cooling jacket is also delivered directly to the body of water in which the watercraft is operated rather than being mixed with the exhaust gases as shown by the parallel discharge path in FIG. 10.

As seen in this figure, the air compressor cooling jacket may be disposed at alternative locations such as between the cylinder head cooling jacket and the expansion chamber cooling jacket as seen at 252*a* or downstream of the expansion chamber cooling jacket as seen at 252*b*.

Thus, from the foregoing description it should be readily apparent that the described embodiments of the invention provide an efficient air fuel injection system for personal watercraft wherein the air compressor is positioned so that water will not be drawn into the compressor system and also so that the air compressor can be conveniently cooled. Of course, the foregoing description is that of preferred embodiments to the invention. Various changes in modifications may be made without departing from the spirit and scope of the invention, as defined by the appended claims.

What is claimed is:

1. A personal watercraft comprised of a hull defining a rider's area adapted to accommodate an operator, rider and no more than three additional passengers, an engine compartment formed within said hull and containing an internal combustion engine for driving a water propulsion device for propelling said hull through a body of water, an air fuel injector for injecting fuel and air under high pressure directly into a combustion chamber of said engine, an air compressor for drawing air through an air inlet and discharging air under pressure to said fuel air injector, the inlet for said air compressor being disposed so that it will be above the level of water within the watercraft regardless of whether the watercraft is operating in a normal position, is inverted and is subsequently righted as to ensure against the ingestion of air into the compressor system.

2. A personal watercraft as set forth in claim 1 wherein the pressure of air delivered to the air fuel injector is regulated by dumping excess air back to the engine compartment.

3. A personal watercraft as set forth in claim 2 wherein excess air discharge is also disposed so that it will be above the level of water within the watercraft regardless of whether the watercraft is operating in a normal position, is inverted and is subsequently righted as to ensure against the ingestion of air into the compressor system.

4. A personal watercraft as set forth in claim 1 wherein the air compressor is also disposed so that it will be above the level of water within the watercraft regardless of whether the watercraft is operating in a normal position, is inverted and is subsequently righted as to ensure against the ingestion of air into the compressor system.

5. A personal watercraft as set forth in claim 4 wherein the pressure of air delivered to the air fuel injector is regulated by dumping excess air back to the engine compartment.

6. A personal watercraft as set forth in claim 5 wherein excess air discharge is also disposed so that it will be above the level of water within the watercraft regardless of whether the watercraft is operating in a normal position, is inverted and is subsequently righted as to ensure against the ingestion of air into the compressor system.

7. A personal watercraft as set forth in claim 1 wherein the air compressor is driven by a crankshaft of the engine.

8. A personal watercraft as set forth in claim 7 wherein the air compressor is directly driven by the crankshaft.

9. A personal watercraft as set forth in claim 7 wherein the air compressor is driven by a crankshaft of the engine through a drive belt.

10. A personal watercraft as set forth in claim 9 wherein the drive belt is directly driven by a crankshaft of the engine.

11. A personal watercraft as set forth in claim 7 wherein the air compressor is driven by a shaft that transmits power from the crankshaft to the water propulsion device.

12. A personal watercraft as set forth in claim 1 further including means for cooling the air compressor.

13. A personal watercraft as set forth in claim 12 wherein the air compressor is cooled by air.

14. A personal watercraft as set forth in claim 12 wherein the air compressor is cooled by water circulated to a cooling jacket of the engine.

15. A personal watercraft comprised of a hull defining a rider's area adapted to accommodate an operator, rider and no more than three additional passengers, an engine compartment formed within said hull and containing an internal combustion engine for driving a water propulsion device for propelling said hull through a body of water, an air fuel injector for injecting fuel and air under high pressure directly into a combustion chamber of said engine, an air compressor for drawing air through an air inlet and discharging air under pressure to said fuel air injector, an engine compartment ventilating arrangement comprising a pair of spaced apart air duct tubes each communicating at one thereof with said engine compartment and at the other end thereof with the atmosphere, and means for cooling said air compressor by placing said air compressor in a location between said engine compartment ends of said air duct tubes.

16. A personal watercraft comprised of a hull defining a rider's area adapted to accommodate an operator, rider and no more than three additional passengers, an engine compartment formed within said hull and containing a water cooled internal combustion engine having a cooling jacket for driving a water propulsion device for propelling said hull through a body of water, an air fuel injector for injecting fuel and air under high pressure directly into a combustion chamber of said engine, an air compressor for drawing air through an air inlet and discharging air under pressure to said fuel air injector, a cooling jacket for said air compressor, and means for circulating water between said cooling jacket of said engine and said air compressor for cooling said air compressor.

* * * * *